United States Patent [19]

Fey et al.

[11] Patent Number: 4,954,170

[45] Date of Patent: Sep. 4, 1990

[54] METHODS OF MAKING HIGH PERFORMANCE COMPACTS AND PRODUCTS

[75] Inventors: Maurice G. Fey, Plum Borough; Natraj C. Iyer, Monroeville; Alan T. Male, Murrysville Boro; William R. Lovic, New Kensington, all of Pa.

[73] Assignee: Westinghouse Electric Corp., Pittsburgh, Pa.

[21] Appl. No.: 374,324

[22] Filed: Jun. 30, 1989

[51] Int. Cl.[5] ..... B22F 1/00

[52] U.S. Cl. ..... 75/229; 75/232; 75/233; 75/234; 75/236; 75/237; 75/238; 75/240; 75/241; 75/243; 75/244; 75/245; 75/246; 75/248; 75/249; 419/11; 419/12; 419/13; 419/14; 419/15; 419/16; 419/17; 419/18; 419/19; 419/21; 419/23; 419/24

[58] Field of Search ..... 75/229, 232–234, 75/236–238, 240, 241, 243–246, 248, 249; 419/11–19, 21, 23, 24, 27, 28, 30, 31, 33, 38, 39, 48, 52, 60

[56] References Cited

U.S. PATENT DOCUMENTS 4,810,289 3/1989 Hoyer et al. ..... 75/232

*Primary Examiner*—Stephen J. Lechert, Jr.

*Attorney, Agent, or Firm*—Daniel P. Cillo

[57] ABSTRACT

High density compacts are made by providing a compactable particulate combination of Class 1 metals selected from at least one of Ag, Cu and Al, with material selected from at least one of CdO, SnO, $SnO_2$, C, Co, Ni, Fe, Cr, $Cr_3C_2$, $Cr_7C_3$, W, WC, $W_2C$, WB, Mo, $Mo_2C$, MoB, $Mo_2B$, TiC, TiN, $TiB_2$, Si, SiC, $Si_3N_4$, usually by mixing powders of each, step (1); uniaxially pressing the powders to a density of from 60% to 95%, to provide a compact, step (2); hot densifying the compact at a pressure between 352 kg/cm$^2$ (5,000 psi) and 3,172 kg/cm$^2$ (45,000 psi) and at a temperature from 50° C. to 100° C. below the melting point or decomposition point of the lower melting component of the compact, to provide densification of the compact to over 97% of theoretical density; step (3); and cooling the compact, step (4).

39 Claims, 4 Drawing Sheets

METHODS OF MAKING HIGH PERFORMANCE COMPACTS AND PRODUCTS

BACKGROUND OF THE INVENTION

1. Field of the Invention

The present invention relates to a method for increasing densification, void elimination and internal bonding between conductive and refractory constituents within compact members used in switches, circuit breakers, and a wide variety of other applications.

2. Description of the Prior Art

Electrical contacts, used in circuit breakers and other electrical devices, contain constituents with capabilities to efficiently conduct high flux energy from arcing surfaces, while at the same time resist erosion by melting and/or evaporation at the arc attachment points. During interruption where currents may be as high as 200,000 amperes, local current densities can approach $10^5$ amps/cm$^2$ at anode surfaces and up to $10^8$ amps/cm$^2$ at cathode surfaces on contacts. Transient heat flux can range up to $10^6$ KW/cm$^2$ at arc roots, further emphasizing the demand for contact materials of the highest thermal and electrical conductivity, and either silver or copper is generally selected Silver is typically selected in air break applications where post-arc surface oxidation would otherwise entail high electrical resistance on contact closure. Copper is generally preferred where other interrupting mediums (oil, vacuum or sulfur hexafluoride) preclude surface oxidation.

Despite the selection of contact metals having the highest conductivity, transient heat flux levels such as that previously mentioned result in local surface temperatures far exceeding the contact melting point (962° C. and 1083° C. for silver and copper, respectively), and rapid erosion would result if either would be used exclusively. For this reason, a second material, generally graphite, a high melting point refractory metal such as tungsten or molybdenum, or a refractory carbide, nitride and/or boride, is used in combination with the conductor to retard massive melting and welding.

Conventional contact production processes generally involve blending powdered mixtures of high conductivity and high melting point materials, and pressing them into compacts, which are then thermally sintered in reducing or inert gas atmospheres. After sintering, the contacts are then infiltrated with conductive metal, which involves placing a metal "slug" onto each contact and heating it in a reducing (or inert) gas atmosphere, this time above the conductor's melting point. The contacts may then be re-pressed to increase density to levels of 96% to 98% of from theoretical and post-treated for final installation into the switching device.

These approaches have several disadvantages in that they have limited process versatility, consist of numerous process steps resulting in a high cost operation, and have a limitation in the achievable densities and performance characteristics. U.S. Pat. No. 4,810,289 (N. S. Hoyer et al.) solved many of these problems, by utilizing highly conductive Ag or Cu, in mixture with CdO, W, WC, Co, Cr, Ni, or C, and by providing oxide clean metal surfaces in combination with a controlled temperature, hot isostatic pressing operation. There, the steps included cold, uniaxial pressing; canning the pressed contacts in a container with separating aid powder; evacuating the container; and hot isostatically pressing the contacts.

The Hoyer et al. process provided full density, high strength contacts, with enhanced metal-to-metal bonds. Such contacts had minimal delamination after arcing, with a reduction in arc root erosion rate. However, such contacts suffered from volumetric shrinkage during processing. What is needed is a method to provide dimensionally reproducible contacts, while still maintaining high strength, resistance to delamination, and enhanced metal-to-metal bonding characteristics. It is a main object of this invention to provide a method of making such superior contacts.

SUMMARY OF THE INVENTION

With the above object in mind, the present invention resides, broadly, in a method of forming a pressed, dense, article characterized by the steps: (1) providing a compactable particulate combination of: (a) Class 1 metals consisting of Ag, Cu, Al, and mixtures thereof, with (b) material selected from the class consisting of CdO, SnO, $SnO_2$, C, Co, Ni, Fe, Cr, $Cr_3C_2$, $Cr_7C_3$, W, WC, $W_2C$, WB, Mo, $Mo_2C$, MoB, $Mo_2B$, TiC, TiN, $TiB_2$, Si, SiC, $Si_3N_4$, and mixtures thereof (2) uniaxially pressing the particulates, having a maximum dimension up to approximately 1,500 micrometers, to a density of from 60% to 95%, to provide a compact; (3) hot densifying the compact at a pressure between 352.5 kg/cm$^2$ (5,000 psi) and 3,172 kg/cm$^2$ (45,000 psi) and at a temperature from 0.5° C. to 100° C. below the melting point or decomposition point of the lower melting component of the compact, to provide densification of the compact to over 97% of theoretical density; and (4) cooling. In this broad embodiment, shown in FIG. 1 of the Drawings, the hot densifying step will preferably be in a vacuum, and particulate combination will generally be a mixture of powders, but other means to combine Class 1 metals with the other materials, for example, pre-alloyed powders, can be utilized. The term "powder" as used throughout, is herein meant to include spherical, fiber and other particle shapes.

The invention also resides in a method of forming a pressed, dense, compact characterized by the steps of: (1) mixing: (a) powders selected from Class 1 metals consisting of Ag, Cu, Al, and mixtures thereof, with (b) powders selected from the class consisting of CdO, SnO, $SnO_2$, C, Co, Ni, Fe, Cr, $Cr_3C_2$, $Cr_7C_3$, W, WC, $W_2C$, WB, Mo, $Mo_2C$, MoB, $Mo_2B$, TiC, TiN, $TiB_2$, Si, SiC, $Si_3N_4$, and mixtures thereof; (2) uniaxially pressing the powders, having a maximum dimension up to approximately 1,500 micrometers, to a density of from 60% to 95%, to provide a compact; (3) placing at least one compact in an open pan having a bottom surface and containing side surfaces where the compact contacts a separation material which aids subsequent separation of the compact and the pan; (4) evacuating air from the pan; (5) sealing the open top portion of the pan, where at least one of the top and bottom surfaces of the pan is pressure deformable; (6) stacking a plurality of the pans next to each other, with plates having a high electrical resistance disposed between each pan so that the pans and plates alternate with each other, where a layer of thermally conductive, granular, pressure transmitting material, having a diameter of up to approximately 1,500 micrometers, is disposed between each pan and plate, which granular material acts to provide uniform mechanical loading to the compacts in the pans upon subsequent pressing, and where the plates and the granular material used to provide uniform loading have a melting point above that of the lowest melting component used in the compacts; (7) placing the stack in a press, passing an electrical current through the pans and high electrical resistance plates to cause a heating effect on the compacts in the pans, and uniaxial pressing the alternating pans and plates where the pressure is between 352.5 kg/cm$^2$ (5,000 psi) and 3,172 kg/cm$^2$ (45,000 psi) and the temperature is from 0.5° C. to 100° C. below the melting point or decomposition point of the lowest melting component in the press, to provide uniform, simultaneous hot-pressing and densification of the compacts in the pans to over 97% of theoretical density; (8) cooling and releasing pressure on the alternating pans and plates; and (9) separating the pans from the plates and the compacts from the pans. This embodiment, shown in FIGS. 2 and 3 of the Drawings, preferably utilizes stainless steel, silicon carbide, or graphite high resistance plates and preferably utilizes a thermally conductive, granular, pressure transmitting material, such as carbon or graphite, to provide uniform loading and heat transfer.

The invention further resides in a method of forming a pressed, dense, compact characterized by the steps: (1) mixing: (a) powders selected from Class 1 metals consisting of Ag, Cu, Al, and mixtures thereof, with (b) powders selected from the class consisting of CdO, SnO, $SnO_2$, C, Co, Ni, Fe, Cr, $Cr_3C_2$, $Cr_7C_3$, W, WC, $W_2C$, WB, Mo, $Mo_2C$, MoB, $Mo_2B$, TiC, TiN, $TiB_2$, Si, SiC, $Si_3N_4$, and mixtures thereof, where from 0 weight % to 100 weight % of non-class 1 powder (b) is in fiber form having lengths at least 20 times greater than their cross section, and where from 30 weight % to 95 weight % of the powder mixture contains Class 1 metals; (2) uniaxially pressing the powders, having a maximum dimension up to approximately 1,500 micrometers, to a large section shape having a density of from 60% to 85%, to provide a large shaped compact; (3) hot pressing the compact in a vacuum at a pressure between 352.5 kg/cm$^2$ (5,000 psi) and 3,172 kg/cm$^2$ (45,000 psi) and at a temperature from 0.5° C. to 100° C. below the melting point or decomposition point of the lowest melting component of the compact, to provide simultaneous hot-pressing and densification of the compact to over 97% of theoretical density; (4) reducing the cross-section of the compact to from ½ to 1/25 of the original cross-section; and (5) cutting the reduced compact. This embodiment, shown in FIG. 4 of the Drawings, preferably contains some fibers, and is hot or cold extruded or rolled in the cross-section reduction step, where any fibers present are deformed in the lengthwise direction, so that upon cutting the reduced cross-section sheet or ribbon, the fibers are oriented perpendicular to the cut surface. Vacuum hot pressing will commonly utilize a canning method or hot pressing the compact directly utilizing a vacuum hot press.

The invention further resides in a method of forming a pressed, dense compact characterized by the steps: (1) mixing: (a) powders selected from Class 1 metals consisting of Ag, Cu, Al, and mixtures thereof, with (b) powders selected from the class consisting of CdO, SnO, $SnO_2$, C, Co, Ni, Fe, Cr, $Cr_3C_2$, $Cr_7C_3$, W, WC, $W_2C$, WB, Mo, $Mo_2C$, MoB, $Mo_2B$, TiC, TiN, $TiB_2$, Si, SiC, $Si_3N_4$, and mixtures thereof; (2) preheating a press die cavity in a vacuum environment and placing the powders, having a maximum dimension up to approximately 1,500 micrometers, in the die cavity; (3) evacuating air from the press to eliminate air voids between the powder particles; (4) pressing the powder at a pressure between 352.5 kg/cm$^2$ (5,000 psi) and 3,172 kg/cm$^2$ (45,000 psi) and at a temperature from 0.5° C. to 100° C. below the melting point or decomposition point of the lower melting component in the press, to provide simultaneous hot-pressing and densification, to form a compact having over 97% of theoretical density; (5) cooling and releasing pressure on the compact; and (6) separating the compact from the die cavity of the press. This embodiment, shown in FIG. 5 of the drawings, will preferably embody a press with multiple die cavities to produce multiple compacts in parallel.

The invention also further resides in a method of forming a pressed, dense, compact characterized by the steps of: (1) mixing: (a) powders selected from Class 1 metals consisting of Ag, Cu, Al, and mixtures thereof, with (b) powders selected from the class consisting of CdO, SnO, $SnO_2$, C, Co, Ni, Fe, Cr, $Cr_3C_2$, $Cr_7C_3$, W, WC, $W_2C$, WB, Mo, $Mo_2C$, MoB, $Mo_2B$, TiC, TiN, $TiB_2$, Si, SiC, $Si_3N_4$, and mixtures thereof, (2) uniaxially pressing the powders, having a maximum dimension up to approximately 1,500 micrometers, to a density of from 60% to 80%, to provide a compact; (3) sintering the compact at a temperature of from 50° C. to 400° C. below the melting point or decomposition point of the lowest melting component of the compact, to effectively eliminate interconnected voids and provide a compact having a density of from 75% to 97%; (4) optionally, melting a powder selected from Class 1 metals onto and into remaining pores in the sintered compact; (5) hot pressing the compact at a pressure between 352.5 kg/cm$^2$ (5,000 psi) and 3,172 kg/cm$^2$ (45,000 psi) and at a temperature from 50° C. to 300° C. below the melting point or decomposition point of the lowest melting component of the compact, to provide simultaneous hot-pressing and densification of the compact to over 97% of theoretical density; and (6) cooling and releasing pressure on the compact. This embodiment is shown in FIG. 6 of the drawings.

In all embodiments of the invention previously described, two optional steps can be included after mixing the powders. These steps are: heating the powders in a reducing atmosphere, at a temperature effective to provide an oxide clean surface on the powders, except CdO, SnO, or $SnO_2$, if present, and more homogeneous distribution of non-Class 1 materials; and granulating the powders after heating, so that their maximum dimension is up to approximately 1,500 micrometers.

These embodiments provide high performance compacts. These compacts can be used as a contact for electronic or electrical equipment, as a composite, for example a contact layer bonded to a highly electrically conductive material of, for example copper, as a heat sink, and the like. The prime powders for contact use include Ag, Cu, CdO, SnO, $SnO_2$, C, Co, Ni, Fe, Cr, $Cr_7C_3$, W, WC, $W_2C$, WB, Mo, $Mo_2C$, MoB, $Mo_2B$, and TiC. The prime powders for heat sink use include Al, TiN, $TiB_2$, Si, SiC, and $Si_3N_4$.

BRIEF DESCRIPTION OF THE DRAWINGS

In order that the invention can be more clearly understood, convenient embodiments thereof will now be described, by way of example, with reference to the accompanying drawings in which.

DESCRIPTION OF THE PREFERRED EMBODIMENTS

Figure 1:
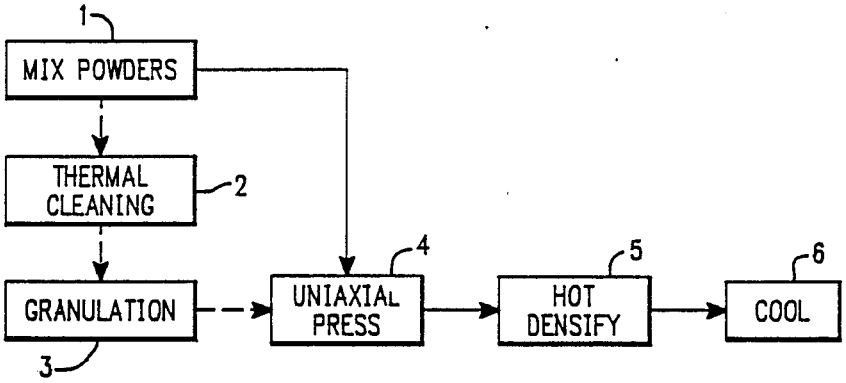
FIG. 1 is a block diagram of the general method of this invention.

Most of the embodiments previously described include particulate combination, as by powder mixing, optional thermal cleaning, optional granulation, and uniaxial pressing, as shown in FIGS. 1 through 6. These four steps will now be described generally for all the embodiments of this invention.

In providing the particulate combination, in most instances, simple powder mixing is adequate, but in some instances alloys may be formed, which alloys may be oxidized or reduced, and then formed into particles suitable for compacting. The usual step is a powder mixing step. Useful powders include many types; for example, a first class, "Class 1", selected from highly conductive metals, such as Ag, Cu, Al, and mixtures thereof. These can be mixed with non-Class 1 powders, i.e., "Class 2" powders, from a class consisting of CdO, SnO, $SnO_2$, C, Co, Ni, Fe, Cr, $Cr_3C_2$, $Cr_7C_3$, W, WC, $W_2C$, WB, Mo, $Mo_2C$, MoB, $Mo_2B$, TiC, TiN, $TiB_2$, Si, SiC, $Si_3N_4$, and mixtures thereof, most preferably CdO, SnO, W, WC, Co, Cr, Ni and C.

The mixture of Al with TiN, $TiB_2$, Si, SiC and $Si_3N_4$ is particularly useful in making articles for heat sink applications. The other materials are especially useful in making contacts for circuit breakers and other electrical switching equipment. When the article to be made is a contact, the Class 1 powders can constitute from 10 wt. % to 95 wt. % of the powder mixture. Preferred mixtures of powders for contact application, by way of example only, include Ag+W; Ag+CdO; Ag+$SnO_2$; Ag+C; Ag+WC; Ag+Ni; Ag+Mo; Ag+Ni+C; Ag+WC+Co; Ag+WC+Ni; Cu+W; Cu+WC; and Cu+Cr. These powders all have a maximum dimension of up to approximately 1,500 micrometers, and are homogeneously mixed.

The powder, before or after mixing, can optionally be thermally treated to provide relatively clean particle surfaces. This usually involves heating the powders at between approximately 450° C., for 95 wt. % Ag+5 wt. % CdO, and 1,100° C., for 10 wt. % Cu+90 wt. % W, for about 0.5 hour to 1.5 hours, in a reducing atmosphere, preferably hydrogen gas or dissociated ammonia. This step can wet the materials, and should remove oxide from the metal surfaces, yet be at a temperature low enough not to decompose the powder present. This step has been found important to providing high densification, especially when used in combination with a hot pressing step later in the process. Where minor amounts of Class 1 powders are used, this step distributes such powders among the other powders, and in all cases provides a homogeneous distribution of Class 1 metal powders.

If the particles have been thermally cleaned, they are usually adhered together. So, they are granulated to break up agglomerations so that the particles are in the range of from 0.5 micrometer to 1,500 micrometers diameter. This optional step can take place after optional thermal cleaning. The mixed powder is then usually placed in a uniaxial press. If automatic die filling is to be utilized in the press, powders over 50 micrometers have been found to have better flow characteristics than powders under 50 micrometers. The preferred powder range for most pressing is from 200 micrometers to 1,000 micrometers.

Optionally, in some instances, to provide a brazeable or solderable surface for the contact, a thin strip, porous grid, or the like, of brazeable metal, such as a silver-copper alloy, or powder particles of a brazeable metal, such as silver or copper, may be placed above or below the main contact powder mixture in the press die. This will provide a composite type structure.

The material in the press is then uniaxially pressed in a standard fashion, without any heating or sintering, at a pressure effective to provide a handleable, "green" compact, usually between 35.25 kg/cm$^2$ (500 psi) and 3,172 kg/cm$^2$ (45,000 psi). This provides a compact that has a density of from 60% to 95% of theoretical. It may be desirable to coat the press with a material which aids subsequent separation of the compacts from the press, such as loose particles and/or a coating of ultrafine particles such as ceramic or graphite particles having diameters, preferably, up to 5 micrometers diameter.

Figure 7A:
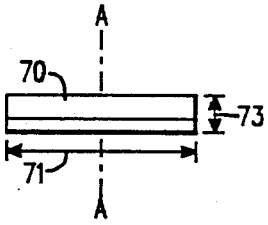
Figure 7B:
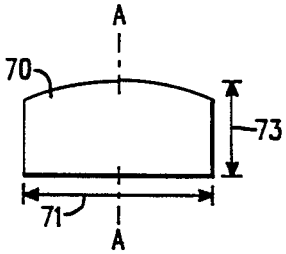
Figure 7C:
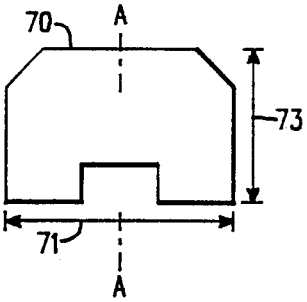

A variety of articles or compacts that may result are shown in FIG. 7. These compacts 70 have a length 71, and height or thickness 73, a height axis A—A, and top and bottom surfaces. The top surface can be flat, and, for example, have a composite structure as when a brazeable layer is disposed on the bottom of the contact as shown in FIG. 7(A). The article or compact can also have a curved top as shown in FIG. 7(B), which is a very useful and common shape, or a bottom slot as shown in FIG. 7(C). In some instances there can be a composition gradient, where, for example, a composition or a particular metal or other powder may be concentrated at a certain level of the article or compact. A useful medium-size contact would be about 1.1 cm long, 0.6 cm wide, and have a beveled top with a maximum height of about 0.3 cm to 0.4 cm.

Referring now to FIG. 1 of the Drawings, the broadest embodiment of the invention is shown in a block diagram. The powder mixing step 1, optional cleaning step 2, optional granulation step 3 and uniaxial pressing step 4, all previously described, are shown, with broken arrows between steps 1 and 2, and 2 and 3, indicating the optional nature of the thermal cleaning and granulation.

The hot densifying or hot pressing step 5 can take place in a sealed pan having deformable top or bottom surfaces into which the compact(s) have been placed. A uniaxial press can be used. If desired, an isostatic press can also be used, where, for example, argon or other suitable gas is used as the medium to apply pressure to the pan and through the pan to the canned compacts. The use of an isostatic press may have certain control characteristics, such as uniformity in temperature and pressure, or other advantages making it very useful. In some instances a vacuum type hot press can be used, eliminating the need for canning. Each type of hot pressing has its advantages and its disadvantages. Isostatic presses and vacuum presses, for example, while allowing greater control or allowing simplification of process steps, represent large capital investments.

This hot press step and its following cooling step are utilized in all the embodiments illustrated in FIGS. 1 through 6, and will now be generally described. Pressure in the hot press step is over approximately 352.5 kg/cm$^2$ (5,000 psi), preferably between 352.5 kg/cm$^2$ (5,000 psi) and 3,172 kg/cm$^2$ (45,000 psi) and most preferably between 1,056 kg/cm$^2$ (15,000 psi) and 2,115 kg/cm$^2$ (30,000 psi). Temperature in this step is preferably from 0.5° C. to 100° C., most preferably from 0.5° C. to 20° C., below the melting point or decomposition point of the lower melting point component of the article or compact, such as the powder constituent, or, the strip of brazeable material if such is to be used, as described previously, to provide densification to over 97%, preferably over 99.5% of theoretical density. There are instances, as where sintering is an included step, where temperatures during hot pressing can be 300° C. below the melting point described. If compacts are canned in pans, as briefly described previously, the pressure provides simultaneous collapse of both the top and bottom of the pan, and through their contact with the compacts, hot-pressing of the articles or compacts, and densification through the pressure transmitting top and bottom of the pan.

Residence time in this hot densifying or pressing step can be from 1 minute to 4 hours, most usually from 5 minutes to 60 minutes. As an example of this step, where a 90 wt. % Ag+10 wt. % CdO powder mixture is used, the temperature in the press step will range from about 800° C. to 899.5° C., where the decomposition point of CdO, for the purpose of this application and in accordance with the *Condensed Chemical Dictionary,* 9th edition, substantially begins at about 900° C. The hot pressed articles or compacts are preferably then gradually brought to room temperature and one atmosphere of pressure over an extended period of time, usually 2 hours to 10 hours. This gradual cooling under pressure is important, particularly if a compact with a composition gradient is used, as it minimizes residual tensile stress in the component layers and controls warpage due to the differences in thermal expansion characteristics. Finally, the articles or compacts are separated from the pan, if one was used.

Contact compacts made by this method have, for example, enhanced interparticle metallurgical bonds, leading to high arc erosion resistance, enhanced thermal stress cracking resistance, and can be made substantially 100% dense. In this process, there is usually no heating of the pressed articles or compacts before the hot pressing step, and stable compacts are produced with minimal stresses.

Figure 2:
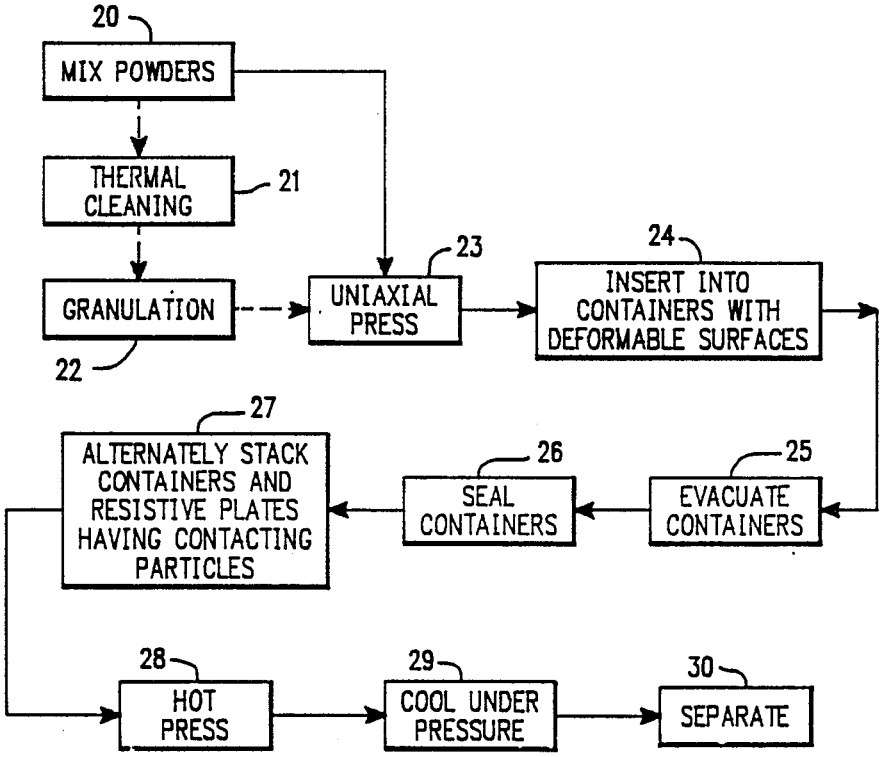
FIG. 2 is a block diagram of a first specific method of this invention.

Referring now to FIG. 2 of the Drawings, a preferred high volume output method of this invention, particularly useful when one surface of the compact is curved rather than flat is illustrated. Previously described powder mixing, optional thermal cleaning, optional granulation, uniaxial pressing, hot pressing, and cooling are shown as steps 20, 21, 22, 23, 28 and 29, respectively. After uniaxial pressing, step 23, the compacts are contacted with, that is coated with a separation or parting material which does not chemically bond to the compacts. The compacts are then placed in a pan container with deformable surfaces, step 24. The compacts are preferably placed in the pan with all their height directions; that is, height axes A—A in FIG. 7, parallel to each other. The pan will have side surfaces which are parallel to the central axis of the pan(s) B—B in FIG. 3. The compacts will have their height axes A—A parallel to the central axis of the pan(s), which will also be parallel to the top-to-bottom side surfaces of the pan(s).

At least one surface of the pan, after sealing, will be pressure deformable and perpendicular to the height axes A—A of the compacts. This pan-type container, in one embodiment, can be a one-piece, very shallow, metal canning pan having an open top end, metal sides, and a thin bottom, with a thin closure lid. All of these pan walls will generally be pressure deformable. Pressure can thus be exerted on the bottom and the closure lid, which in turn will apply pressure to the compacts along their height axes A—A. Exerting pressure in this fashion will press the compacts to close to 100% of theoretical density, if desired. The pans, 31 in FIG. 3, can be made of thin gauge steel, and the like high temperature stable material. It is possible to press single or multiple layers of compacts in each pan. When multiple layers of compacts are to be pressed, the layers must have interposed pressure transmitting, separation or parting material between layers of compacts, for example, a thin, graphite coated steel sheet.

All the compacts should be close packed so that there are no significant gaps between the compacts and the side surfaces of the pan. A thin wall top lid is fitted over the pan, air is evacuated, step 25 in FIG. 2, and the top lid is sealed to the pan at the pan edges, such as by welding, or the like, step 26, to provide a top surface for the pan. The sealing can be accomplished in a vacuum container, thus combining the steps of sealing the lid and evacuating the pan. Alternatively, the pan may be designed with an evacuation port, so that evacuation and sealing can be performed after welding.

Each pan can accommodate a large number, for example, 1,000 side-by-side articles or compacts, and a plurality of sealed pans are stacked together to be hot pressed simultaneously, step 27. Usually, at least twelve articles or compacts will be simultaneously hot pressed. In the container, each compact is surrounded by a material which aids subsequent separation of compact and pan material as mentioned previously, such as loose particles, and/or a coating of ultrafine particles, and/or high temperature cloth. The separation material is preferably in the form of a coating or loose particles of ceramic, such as alumina or boron nitride, or graphite, up to 5 micrometers diameter, preferably submicron size.

Figure 3:
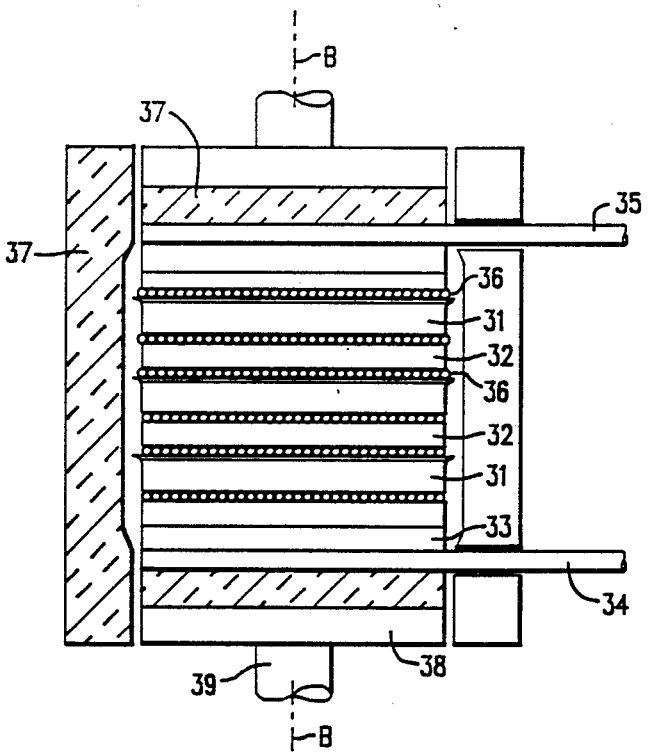
FIG. 3 is a front view, partially sectioned, showing one stack up configuration of the first specific method of this invention.

Referring now to FIG. 3, which details step 27 of FIG. 2, alternate layers of compacts, arranged and sealed as previously described in individual pans 31, are stacked along with plates 32 of a metal having relatively high electrical resistance, onto a bottom thermal guard plate 33, with high current capacity electrical conductors 34 and 35 located at each end of the stack. The high resistance plates 32 can be made from a material selected from stainless steel, silicon carbide, graphite, nickel, molybdenum, tungsten, nickel alloys, chromium alloys, and the like, high temperature, high resistance materials. A layer of a thermally conductive, granular, pressure transmitting material 36, having diameters up to approximately 1,500 micrometers, preferably from 100 micrometers 1,500 micrometers, most preferably from 100 micrometers to 500 micrometers, separates each pan 31 from the adjacent metal resistor plate 32, to provide heat transfer and uniform mechanical loading to the contacts in the event that the final desired surface of the compacts is not flat, for example, the compact shown in FIG. 7(B) or 7(C). The powdered, electrically conducting material layer 36 can be carbon or graphite or other material that will not chemically react with the pans.

The stack of pans 31 and resistor plates 32 is enclosed within thermal insulation 37 and placed into a press as shown in FIG. 3. The required force is applied and sufficient current is passed through the stacked pans 31 and resistor plates 32, through the electrical conductors 34 and 35, to raise the temperature to the required level for hot compaction. Also shown are support plates 38 and press rams 39, as well as the central axis B—B of the pans. The canned compacts are then placed in a hot press, step 28. A uniaxial press can be used. As final steps, the compacts are cooled under pressure, step 29, also previously described, and then separated from the pans.

EXAMPLE 1

A summary of one set of operating parameters for an example case, involving the method immediately preceding and illustrated in FIGS. 2 and 3, is as follows:

(1) Pan sheet size: 25.4 cm×25.4 cm for about 1,000 small size contacts in a single layer, the contacts having a composition as hereinbefore specified.

(2) Insert 1.27 cm thick stainless steel (or other high resistance metal) plates between the pans to function as heating elements, as well as graphite powder as the electrically conducting layer that is effective to provide uniform mechanical loading.

(3) Insulate the periphery of the stack (pans and resistor plates) to prevent lateral heat loss.

(4) Processing pressing temperature: 960° C. in a standard hot forming press. Process rates: 65 pans per load (maximum).

(5) Provide required thermal energy (to 960° C.) by resistance heating the pans.

(6) Sensible heat: 50 KWHr to achieve 960° C.

Assume two-hour ramp time to achieve 960° C.

Heat input=25 KW.

R=10 $\mu\Omega$ (will vary with temperature).

I=30.7 KA; V=0.8 volts.

Figure 4:
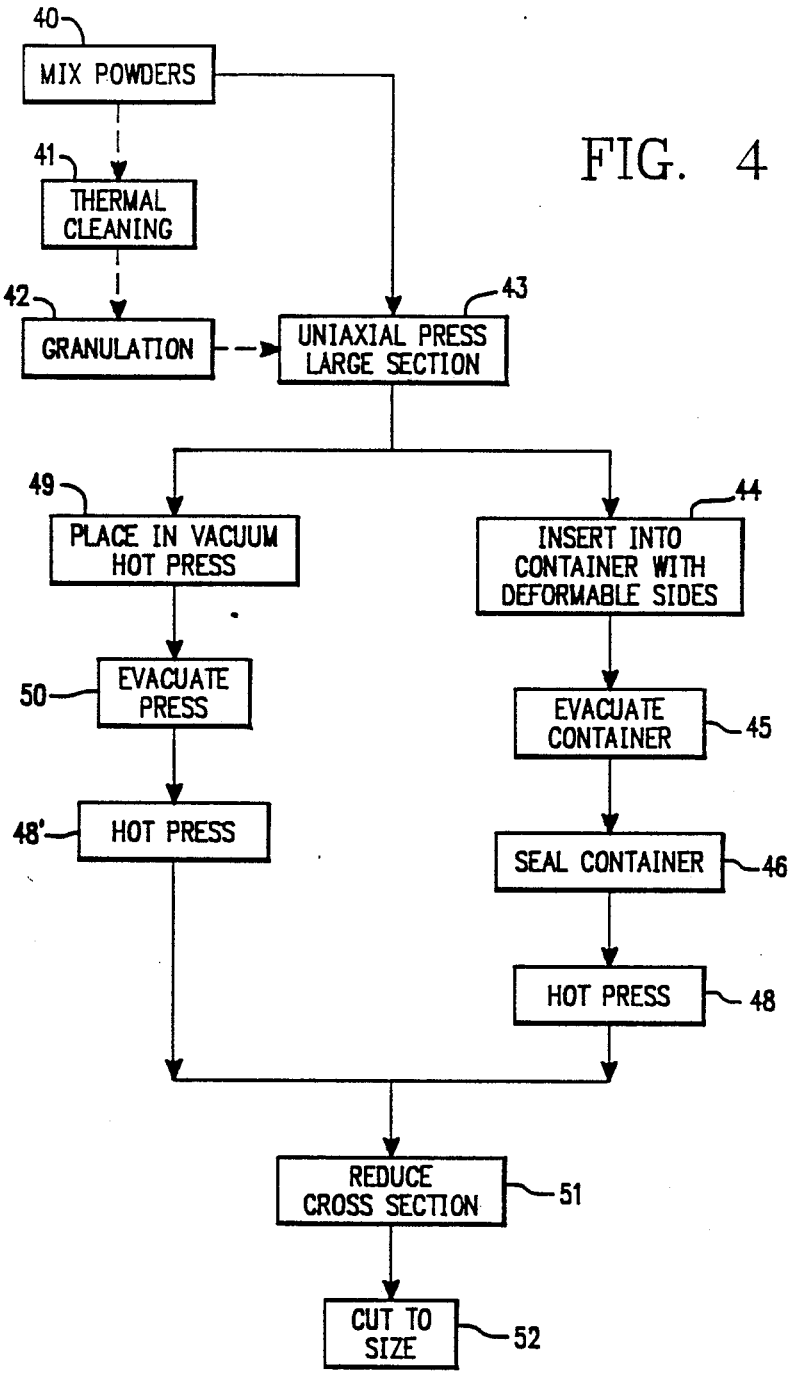
FIG. 4 is a block diagram of a second specific method of this invention.

Referring now to FIG. 4 of the Drawings, a process for bulk block formation, hot pressing and cross section reduction of the block, and shearing to size, is shown, where fibers are preferably included in the block, so that upon shearing to size a preferred fiber orientation is achieved. Previously described powder mixing, optional thermal cleaning, optional granulation, uniaxial pressing, and hot pressing are shown as steps 40, 41, 42, 43, 48 and 48', respectively. Here, however, since a larger section is to be cold pressed, and rolling or extrusion, and shearing steps are to be utilized, from 30 weight % to 95 weight % of the powders must be the high temperature ductile metals of Class 1, that is, Ag, Cu or Al. Preferably from 70 weight % to 95 weight % will be Class 1 metals. The non-Class 1 powders can contain from 0 weight % to 100 weight % fibers. Cold uniaxial pressing in this embodiment will be between 7,050 kg/cm$^2$ (100,000 psi) and 14,100 kg/cm$^2$ (200,000 psi), to provide a compact having a density of from 60% to 85% of theoretical. Usually only one large block will be pressed at a time in the cold uniaxial pressing step. A heavy duty press is required, and the press die faces must be heavily lubricated.

This embodiment will usually be used to provide cylindrical or rectangular shapes about 1.27 cm to 1.90 cm in diameter×10.16 cm to 20.32 cm long, or 5.08 cm to 10.16 cm wide×10.16 cm to 20.32 cm long×1.27 cm to 1.90 cm thick, respectively. After uniaxial pressing, step 43 in FIG. 4, the large section is hot pressed in a vacuum by either of two options. In one option, the large section is placed in a large pan container having deformable surfaces and inside dimensions fractionally larger than the outside dimensions of the shape, step 44.

At least one surface of the pan, after sealing, will be pressure deformable. This pan-type container, in one embodiment, can be a one-piece, deep, metal canning pan having an open top end, metal sides, and a thin bottom, with a thin closure lid. All of these pan walls will generally be pressure deformable. Pressure can thus be exerted on the bottom and the closure lid, which in turn apply pressure to the shape.

The pans can be made of thin gauge steel, and the like high temperature stable material. The pan will usually have an evacuation tube on its side so that after a thin wall top lid is fitted over the pan, air is evacuated, and the top lid is sealed to the pan at the pan edges, step 46, such as by welding, or the like, to provide a top surface for the pan. The sealing can be accomplished in a vacuum container, thus combining the steps of sealing the lid and evacuating the pan. In the pan, the large shaped compact is surrounded by a material which aids subsequent separation of compact and pan material such as loose particles, and/or a coating of ultrafine particles, and/or high temperature cloth. The separation material is preferably in the form of a coating or loose particles of ceramic, such as alumina or boron nitride, or graphite, up to 5 micrometers diameter. Hot pressing, step 48, is as previously described, to provide a compact of over 97% of theoretical density.

The other option leading to hot pressing is use of a vacuum hot press. These presses, while expensive, are commercially available and usually comprise a press body having machined graphite dies, where the press chamber can be sealed and a vacuum drawn on the material to be pressed.

Here, the large section is placed between the press dies of a vacuum hot press, step 49, the press chamber is sealed and a vacuum is drawn on the compact, step 50, as the compact is gradually hot pressed, step 48'. The hot pressing, step 48', is as previously described, to provide a compact of over 97% of theoretical density.

The densified, pressed compact is then reduced in cross section by hot or cold rolling, hot or cold extrusion or a similar technique, step 51, to reduce the cross-section of the compact to from ½ to 1/25 of the original cross section. This will probably involve multiple passes if rolling is used. The higher the percentage of Class 1 metals the more likely cold rolling or cold extrusion will be effective. Finally, the reduced compact is cut to size by an appropriate means, such as shearing with a SiC blade, laser cutting, water jet cutting with abrasives, or the like, step 52, to provide a compact of the shape and dimensions desired. The cut surface will usually be the face surface of contacts formed from the compact. During rolling or extruding, any fibers present in the compact will be deformed in the lengthwise direction. When the compacts are cut to the final thickness, the fibers will be advantageously oriented perpendicular to the compact surface. Preferably, in this embodiment the fiber content of the non-Class 1 materials will preferably range from 10 weight % to 75 weight %, most preferably from 30 weight % to 60 weight %.

EXAMPLE 2

A summary of one set of operating parameters for an example case, involving the method immediately preceding and illustrated in FIG. 4, for the canning option, is as follows:

(1) Mix 80 weight % of Class 1 metal with 20 weight % of non-Class 1 materials, which latter materials contain 75 weight % fibers having lengths 50 times greater than their cross section.
(2) Uniaxial press a block 5.08 cm wide × 10.16 cm long × 1.27 cm thick at 7,050 kg/cm$^2$ (100,000 psi).
(3) Coat the block with graphite separation powder.
(4) Place the block in a large pan having internal dimensions a fraction larger than the block.
(5) Seal the can and evacuate to $10^{-4}$ Torr.
(6) Hot isostatic press at 960° C. and 1,410 kg/cm$^2$ (20,000 psi).
(7) Cool over 4 to 5 hours and remove the can.
(8) Cold roll the block in multiple steps of approximately 15% reduction/pass, for about 10 passes to a thickness of about 0.35 cm.
(9) Cut, for example, by a heavy duty ceramic tipped shear.

Figure 5:
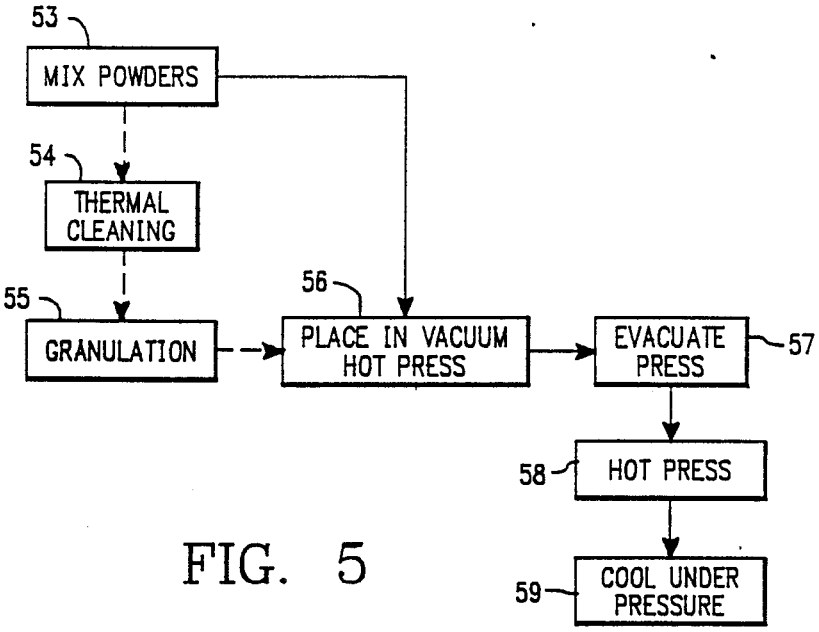
FIG. 5 is a block diagram of a third specific method of this invention.

Referring now to FIG. 5 of the Drawings, a simplified process, using vacuum hot pressing techniques without initial uniaxial cold pressing is described. Previously described powder mixing, optional thermal cleaning, optional granulation, hot pressing, and cooling are shown as steps 53, 54, 55, 58, and 59, respectively. Here, hot pressing utilizes a vacuum hot press. These presses, while expensive, are commercially available and usually comprise a press body having machined graphite dies, where the press chamber can be sealed and a vacuum drawn on the material to be pressed. Here the die(s) must contain multiple cavities machined close to the final desired contact dimensions, so that for each shape of contact, a separate die will be required. The die cavities may also be heavily lubricated.

The powder will be placed in a preheated press die, step 56, in an amount calculated to provide appropriate dimensions at the required density, and the press evacuated, step 57. The evacuation step must be carefully controlled so that the powder, which has not been uniaxially pressed into a "green" compact, is not carried out of the press dies with the escaping air. This process may require a fairly sophisticated degree of vacuum controls. The hot pressing, step 58 is as previously described, to provide a compact of over 97% of theoretical density. Finally, the press temperature is slowly decreased and the compacts are separated from the die cavity of the press.

EXAMPLE 3

A summary of one set of operating parameters for an example case, involving the method immediately preceding and illustrated in FIG. 5, is as follows:

(1) Mix 35 weight % of Class 1 metal into the powder mixture.
(2) Place the required amount of powder in graphite die cavities machined to the final desired contact dimensions, in a vacuum press.
(3) Very slowly evacuate the press to $10^{-4}$ Torr.
(4) Gradually heat the press to 960° C. and press at 1,410 kg/cm$^2$ (20,000 psi).
(5) Cool over 4 hours and remove the compacts from the press.

Figure 6:
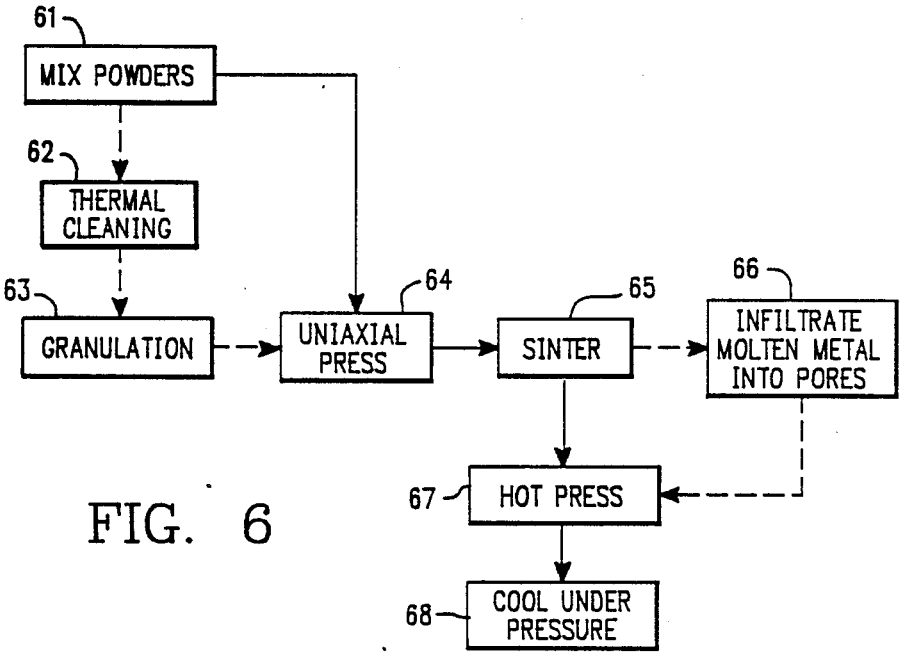
FIG. 6 is a block diagram of a fourth specific method of this invention.

Referring now to FIG. 6 of the Drawings, a double pressing-sintering process is shown which does not rely solely for final densification on the single hot press operation, and which can utilize low pressure presses and low temperature processing. Previously described powder mixing, optional thermal cleaning, optional granulation, cold uniaxial pressing, hot pressing, and cooling are shown as steps 61, 62, 63, 64, 67 and 68, respectively. Uniaxial pressing, step 64 is preferably between 352.5 kg/cm$^2$ (500 psi) and 2,115 kg/cm$^2$ (30,000 psi) to provide a "green" compact of at most 80% density, rather than the usual 95% density. Preferred density is between 60% and 80%. This can allow use of less expensive presses.

Following cold pressing, the compacts are sintered in a furnace at a temperature of from 50° C. to 400° C. below the melting point or decomposition point of the lowest melting component of the compact. The sintering effectively eliminates interconnected voids in the compact and provides a compact having an increased density, in the range of 75% to 97%, step 65. If, after sintering, the density is below 87%, or if desired regardless of density, the compact can be infiltrated by melting Class 1 metals, in powder small slug or ball form, usually individually, onto and into remaining pores in the sintered compact. The temperature used in this step is usually from 75° C. to 125° C. above the melting point of the Class 1 metal. To achieve good infiltration, the compact surface may have to be scored or serrated in some fashion. Infiltration will usually provide a 94% to 97% dense compact. Thus, after sintering and optionally infiltrating, densities may already be at 97%, so that final hot pressing may be possible using less expensive presses.

Final hot pressing, step 67, is as previously described, except it is accomplished at a temperature of only from 50° C. to 300° C. below the melting point or decomposition point of the lowest melting component of the compact, and pressures of from 352.5 kg/cm$^2$ (5,000 psi) to 2,115 kg/cm$^2$ (30,000 psi) are usually sufficient. Canning the compact(s) is not required in the hot press step, neither is use of a vacuum.

EXAMPLE 4

A summary of one set of operating parameters for an example case, involving the method immediately preceding and illustrated in FIG. 6, is as follows:

(1) Mix 35 weight % of Class 1 metal into the powder mixture.
(2) Uniaxial press at 705 kg/cm$^2$ (10,000 psi) to a density of 75% for the compact.
(3) Sinter in an oven at 200° C. below the melting point of the lowest melting component of the compact to increase density to 85%.
(4) Place a slug of Class 1 metal onto the contact and heat to 100° C. above the melting point of the Class 1 metal to infiltrate and densify to 97%.
(5) Hot press without canning or a vacuum at 1,410 kg/cm$^2$ (20,000 psi) and at 200° C. below the melting point of the lowest melting component of the compact.
(6) Cool over 4 hours.

We claim:

1. A method of forming a pressed, dense compact, comprising the steps:

(1) providing a compactable particulate combination of:
  (a) Class 1 metals selected from the group consisting of Ag, Cu, Al, and mixtures thereof, with
  (b) material selected from the class consisting of CdO, SnO, $SnO_2$, C, Co, Ni, Fe, Cr, $Cr_3C_2$, $Cr_7C_3$, W, WC, $W_2C$, WB, Mo, $Mo_2C$, MoB, $Mo_2B$, TiC, TiN, $TiB_2$, Si, SiC, $Si_3N_4$, and mixtures thereof;

(2) uniaxially pressing the particulate combination, having a maximum dimension up to approximately 1,500 micrometers, to a density of from 60% to 95%, to provide a compact;

(3) placing at least one compact in an open pan having a bottom surface and containing side surfaces where the compact contacts a separation material which aids subsequent separation of the compact and the pan;

(4) evacuating air from the pan;

(5) sealing the open top portion of the pan, where at least one of the top and bottom surfaces of the pan is pressure deformable;

(6) stacking a plurality of the pans next to each other, with plates having a high electrical resistance disposed between each pan so that the pans and plates alternate with each other, where a layer of thermally conductive, granular, pressure transmitting material, having a diameter of up to approximately 1,500 micrometers, is disposed between each pan and plate, which granular material acts to provide heat transfer and uniform mechanical loading to the compacts in the pans upon subsequent pressing, and where the plates and the granular material used to provide uniform loading having a melting point above that of the lowest melting component used in the compacts;

(7) placing the stack in a press, passing an electrical current through the pans and high electrical resistance plates to cause a heating effect on the compacts in the pans, and uniaxial pressing the alternating pans and plates, where the pressure is between 352.5 kg/cm$^2$ (5,000 psi) and 3,172 kg/cm$^2$ (45,000 psi) and the temperature is from 0.5° C. to 100° C. below the melting point or decomposition point of the lowest melting component in the press, to provide uniform, simultaneous hot-pressing and densification of the compacts in the pans to over 97% of theoretical density;

(8) cooling and releasing pressure on the alternating pans and plates; and (9) separating the pans from the plates and the compacts from the pans.

2. The method of claim 1, where, after step 1, and before pressing in step 2 the particulate combination is heated in a reducing atmosphere, at a temperature effective to provide an oxide clean surface, except CdO, SnO, or $SnO_2$, if present, and more homogeneous distribution of non-Class 1 materials; and granulating the particulate combination after heating, so that their maximum dimension is up to approximately 1,500 micrometers.

3. The method of claim 1, where the 1(a) metals are selected from the class consisting of Ag, Cu, and mixtures thereof, and the 1(b) material is selected form the group consisting of CdO, SnO, $SnO_2$, C, Co, Ni, Fe, Cr, $Cr_3C_2$, $Cr_7C_3$, W, WC, $W_2C$, WB, Mo, $Mo_2C$, MoB, $Mo_2B$, TiC, and mixtures thereof.

4. The method of claim 1, where the hot pressing in step 7 is from 1,056 kg/cm$^2$ (15,000 psi) to 2,115 kg/cm$^2$ (30,000 psi), and the temperature is from 0.5° C. to 20° C. below the melting point or decomposition point of the lower melting constituent.

5. The method of claim 1, where the compactable particulate combination is selected from the group consisting of Ag+W; Ag+CdO; Ag+$SnO_2$; Ag+C; Ag+WC; Ag+Ni; Ag+Mo; Ag+Ni+C; Ag+WC; Ag+WC+Co; Ag+WC+Ni; Cu+W; Cu+WC; and Cu+Cr.

6. The method of claim 1, where the compactable particulate combination is contacted with a brazeable metal strip after step 1 and prior to step 2.

7. The method of claim 1, where the high resistance plates are made from a material selected from the group consisting of stainless steel, silicon, carbine, graphite, nickel, molybdenum, tungsten, nickel alloys, and chromium alloys, and the granular pressure transmitting material between the plates will not chemically react with the pans and is selected from the group consisting of carbon and graphite particles having diameters between 100 micrometers and 1500 micrometers.

8. A high density contact made by the method of claim 1.

9. A method of forming a pressed, dense compact, comprising the steps:

(1) providing a compactable particulate combination of:

(a) Class 1 metals selected from the group consisting of Ag, Cu, Al, and mixtures thereof, with (b) material selected from the class consisting of CdO, SnO, $SnO_2$, C, Co, Ni, Fe, Cr, $Cr_3C_2$, $Cr_7C_3$, W, WC, $W_2C$, WB, Mo, $Mo_2C$, MoB, $Mo_2B$, TiC, Tin, $TiB_2$, Si, SiC, $Si_3N_4$, and mixtures thereof, where from 10 weight % to 75 weight % of non-Class 1 material (b) is in fiber form having lengths at least 20 times greater than their cross-section, and where from 30 weight % to 95 weight % of the particulate combination contains Class 1 metals;

(2) uniaxially pressing the particulate combination, having a maximum dimension up to approximately 1,500 micrometers, to a large section shape having a density of from 60% to 85%, to provide a large shaped compact;

(3) hot pressing the compact in a vacuum at a pressure between 352.5 kg/cm$^2$ (5,000 psi) and 3,172 kg/cm$^2$ (45,000 psi) and at a temperature from 0.5° C. to 100° C. below the melting point or decomposition point of the lower melting component of the compact, to provide simultaneous hot-pressing and densification of the compact to over 97% of theoretical density;

(4) reducing the cross-section of the compact to from ½ to 1/25 of the original cross-section so that fibers present are deformed in the lengthwise direction; and (5) cutting the reduced compact so that the fibers are oriented perpendicular to a compact surface.

10. The method of claim 9, where after step 2 and prior to step 3, at least one shaped compact is placed in a preheated press in a vacuum environment.

11. The method of claim 9, where, after step 1, and before pressing in step 2 the particulate combination is heated in a reducing atmosphere, at a temperature effective to provide an oxide clean surface, except CdO, SnO, or $SnO_2$, if present, and more homogeneous distribution of non-Class 1 materials; and granulating the particulate combination after heating, so that their maximum dimension is up to approximately 1,500 micrometers.

12. The method of claim 9, where the 1(a) metals are selected from the class consisting of Ag, Cu, and mixtures thereof, and the 1(b) material is selected from the group consisting of CdO, SnO, $SnO_2$, C, Co, Ni, Fe, Cr, $Cr_3C_2$, $Cr_7C_3$, W, WC, $W_2C$, WB, Mo, $Mo_2C$, MoB, $Mo_2B$, TiC, and mixtures thereof.

13. The method of claim 9, where the compactable particulate combination contains from 70 weight % to 95 weight % of Class 1 metals and pressing in step 2 is between 7,050 kg/cm$^2$ (100,000 psi) and 14,100 kg/cm$^2$ (200,000 psi).

14. The method of claim 9, where the compactable particulate composition is selected from the group consisting of Ag+W; Ag+CdO; Ag+$SnO_2$; Ag+C; Ag+WC; Ag+Ni; Ag+Mo; Ag+Ni+C; Ag+WC+Co; Ag+WC+Ni; Cu+W; Cu+WC; and Cu+Cr, and where the compactable particular composition is connected with a brazeable metal strip after step 1 and prior to step 2.

15. A high density contract made by the method of claim 9.

16. A method of forming a pressed, dense compact, comprising the steps:

(1) providing a compactable particulate combination of:

(a) class 1 metals selected from the group consisting of Ag, Cu, Al, and mixtures thereof, with (b) material selected from the class consisting of CdO, SnO, $SnO_2$, C, Co, Ni, Fe, Cr, $Cr_2C$, W, WC, $W_2C$, WB, Mo, MoC, $Mo_2C$, MoB, $Mo_2B$, TiC, TiN, $TiB_2$, Si, SiC, $Si_3N_4$, and mixtures thereof; and then (2) preheating a press die cavity in a vacuum environment and placing the particulate combination, having a maximum dimension up to approximately 1,500 micrometers, in the die cavity, where the die cavity is machined close to the final desired compact dimensions and where the particulate combination is placed in the cavity in an amount calculated to provide appropriate dimensions at the required density; and then (3) evacuating air from the press in a controlled manner so that particulates are not carried out of the press with the escaping air, and to eliminate air voids between the particulate combination; and then (4) pressing the particulate combination at a pressure between 352.5 kg/cm$^2$ (5,000 psi) and 3,172 kg/cm$^2$ (45,000 psi) and at a temperature from 0.5° C. to 100° C. below the melting point or decomposition point of the lower melting component in the press, to provide simultaneous hot-pressing and densification, to form a compact having over 97% of theoretical density;

(5) cooling and releasing pressure on the compact; and (6) separating the compact from the die cavity of the press.

17. The method of claim 16, where, after step 1, and before preheating the die cavity in step 2 the particulate combination is heated in a reducing atmosphere, at a temperature effective to provide an oxide clean surface, except CdO, SnO, or $SnO_2$, if present, and more homogeneous distribution of non-Class 1 materials; and granulating the particulate combination after heating, so that their maximum dimension is up to approximately 1,500 micrometers.

18. The method of claim 16, where the 1(a) metals are selected from the class consisting of Ag, Cu, and mixtures thereof, and the 1(b) materials are selected from the group consisting of CdO, SnO, $SnO_2$, C, Co, Ni, Fe, Cr, $Cr_3C_2$, $Cr_7C_3$, W, WC, $W_2C$, WB, Mo, $Mo_2C$, MoB, $Mo_2B$, TiC, and mixtures thereof.

19. A high density contact made by the method of claim 16.

20. A method of forming a pressed, dense, compact, comprising the steps of:

(1) providing a compactable particulate combination of:

(a) Class 1 metals selected from the group consisting of Ag, Cu, Al, and mixtures thereof, with (b) material selected from the class consisting of CdO, SnO, $SnO_2$, C, Co, Ni, Fe, Cr, $Cr_3C_2$, $Cr_7C_3$, W, WC, $W_2C$, WB, Mo, $Mo_2C$, MoB, $Mo_2B$, TiC, TiN, $TiB_2$, Si, SiC, $Si_3N_4$, and mixtures thereof;

(2) uniaxially pressing the particulate combination, having a maximum dimension up to approximately 1,500 micrometers, to a density of from 60% to 80%, to provide a compact;

(3) sintering the compact at a temperature of from 50° C. to 400° C. below the melting point or decomposition point of the lowest melting component of the compact, to effectively eliminate interconnected voids and provide a compact having a density of from 75% to 97%;

(4) hot pressing the compact at a pressure between 352.5 kg/cm$^2$ (5,000 psi) and 2,115 kg/cm$^2$ (30,000 psi) and at a temperature from 502 C. to 300° C. below the melting point or decomposition point of the lowest melting component of the compact, to provide simultaneous hot-pressing and densification of the compact to over 97% of theoretical density; and (5) cooling and releasing pressure on the compact.

21. The method of claim 20, where, after step 1, and before pressing in step 2 the particulate combination is heated in a reducing atmosphere, at a temperature effective to provide an oxide clean surface, except CdO, SnO, or $SnO_2$, if present, and more homogeneous distribution of non-Class 1 materials; and granulating the particulate combination after heading, so that their maximum dimension is up to approximately 1,500 micrometers.

22. The method of claim 20, where the 1(a) metals are selected from the class consisting of Ag, Cu, and mixtures thereof, and the 1(b) materials are selected from the group consisting of CdO, SnO, $SnO_2$, C, Co, Ni, Fe, Cr, $Cr_3C_2$, $Cr_7C_3$, W, WC, $W_2C$, WB, Mo, $Mo_2C$, MoB, $Mo_2B$, TiC, and mixtures thereof.

23. The method of claim 20, where pressing in step 2 is between 352.5 kg/cm$^2$ (500 psi) and 2,115 kg/cm$^2$ (30,000 psi).

24. The method of claim 20, where pressing in step (4) is between 352 kg/cm$^2$ (5,000 psi) and 2,115 kg/cm$^2$ (30,000 psi).

25. The method of claim 20, where the compactable particulate combination is selected from the group consisting of Ag+W; Ag+CdO; Ag+$SnO_2$; Ag+C; Ag+WC; Ag+Ni; Ag+Mo; Ag+Ni+C; Ag+WC+Co; Ag+WC+Ni; Cu+W; Cu+WC; and Cu+Cr.

26. The method of claim 20, where the compactable particulate combination is contacted with a brazeable metal strip after step 1 and prior to step 2.

27. A high density contact made by the method of claim 20.

28. The method of claim 1, where the particulate combination is made by mixing (1)(a) Class 1 metal powder and (1)(b) powder material.

29. The method of claim 9, where the particulate combination is made by mixing (1)(a) Class 1 metal powder and (1)(b) powder material.

30. The method of claim 16, where the particulate combination is made by mixing (1)(a) Class 1 metal powder and (1)(b) powder material.

31. The method of claim 20, where the particulate combination is made by mixing (1)(a) Class 1 metal powder and (1)(b) powder material.

32. A method of forming a pressed, dense compact, comprising the steps:

(1) providing a compactable particulate combination of:

(a) Class 1 metals selected from the group consisting of Ag, Cu, Al, and mixtures thereof, with (b) material selected from the class consisting of CdO, SnO, $SnO_2$, C, Co, Ni, Fe, Cr, $Cr_3C_2$, $Cr_7C_3$, W, WC, $W_2C$, WB, Mo, $Mo_2C$, MoB, $Mo_2B$, TiC, TiN, $TiB_2$, Si, SiC, $Si_3N_4$, and mixtures thereof, where from 10 weight % to 75 weight % of non-Class 1 material (b) is in fiber form having lengths at least 20 times greater than their cross-section, and where from 30 weight % to 95 weight % of the particulate combination contains Class 1 metals;

(2) uniaxially pressing the particulate combination, having a maximum dimension up to approximately 1,500 micrometers, to a large section shape having a density of from 60% to 85%, to provide a large shaped compact;

(3) placing at least one shaped compact in an open pan having a bottom surface and containing side surfaces, where the compact contracts a separation material which aids subsequent separation of the compact and the pan;

(4) evacuating air from the pan;

(5) sealing the open top portion of the pan, where at least one of the top and bottom surfaces of the pan is pressure deformable;

(6) hot pressing the compact through the pan at a pressure between 352.5 kg/cm$^2$ (5,000 psi) and 3,172 kg/cm$^2$ (45,000 psi) and at a temperature from 0.5° C. to 100° C. below the melting point or decomposition point of the lowest melting component of the compact, to provide simultaneous hot-pressing and densification of the compact to over 97% of theoretical density;

(7) reducing the cross-section of the compact to from ½ to 1/25 of the original cross-section so that fibers present are deformed in the lengthwise direction; and (8) cutting the reduced compact so that the fibers are oriented perpendicular to a compact surface.

33. The method of claim 32, where the particulate combination is made by mixing (1)(a) Class 1 metal powder and (1)(b) powder material.

34. The method of claim 32, where, after step 1, and before pressing in step 2, the particulate combination is heated in a reducing atmosphere, at a temperature effective to provide an oxide clean surface, except CdO, SnO, or $SnO_2$, if present, and more homogeneous distribution of non-Class 1 materials; and granulating the particulate combination after heating, so that the maximum dimension is up to approximately 1,500 micrometers.

35. The method of claim 32, where the (1)(a) metals are selected from the class consisting of Ag, Cu, and mixtures thereof, and the (1)(b) material is selected from the group consisting of CdO, SnO, $SnO_2$, C, Co, Ni, Fe, Cr, $Cr_3C_2$, $Cr_7C_3$, W, WC, $W_2C$, WB, Mo, $Mo_2C$, MoB, $Mo_2B$, TiC, and mixtures thereof.

36. The method of claim 32, where the compactable particulate combination contains from 70 weight % to 95 weight % of Class 1 metals and pressing in step 2 is between 7,050 kg/cm$^2$ (100,000 psi) and 14,100 kg/cm$^2$ (200,000 psi).

37. The method of claim 32, where the compactable particulate combination is selected from the group consisting of Ag+W; Ag+CdO; Ag+$SnO_2$; Ag+C; Ag+WC; Ag+Ni; Ag+Mo; Ag+Ni+C; Ag+WC+Co; Ag+WC+Ni; Cu+W; Cu+WC; and Cu+Cr, and where the compactable particulate combination is contacted with a brazeable metal strip after step 1 and prior to step 2.

38. A high density contract made by the method of claim 32.

39. The method of claim 20, where, after step (3) and before step (4), a powder selected from Class 1 metals is melt infiltrated onto and into the remaining pores in the sintered compact at a temperature from 75° C. to 125° C. above the melting point of the Class 1 metal used, to provide a compact having a density of from about 94% to 97%.

* * * * *